United States Patent [19]

Choi

[11] 4,351,477

[45] Sep. 28, 1982

[54] POP-UP SPRINKLER

[75] Inventor: Mansam Choi, 922 S. Cabrillo Dr., Duarte, Calif. 91010

[73] Assignee: Anthony Manufacturing Corporation, Azusa, Calif.

[21] Appl. No.: 175,121

[22] Filed: Aug. 4, 1980

[51] Int. Cl.[3] ..... B05B 15/10

[52] U.S. Cl. ..... 239/205; 239/DIG. 1

[58] Field of Search ..... 239/203-205, 239/123, DIG. 1

[56] References Cited

U.S. PATENT DOCUMENTS

| | | | |
|---|---|---|---|
| 2,214,852 | 9/1940 | De Lacy-Mulhall | 239/204 |
| 3,272,436 | 9/1966 | Hunter . | |
| 3,331,292 | 7/1967 | Seablom | 239/203 |
| 3,650,478 | 3/1972 | Jones . | |
| 4,132,358 | 1/1979 | Keely . | |
| 4,220,283 | 9/1980 | Citron . | |

*Primary Examiner*—Robert B. Reeves
*Assistant Examiner*—Michael J. Forman
*Attorney, Agent, or Firm*—Fulwider, Patton, Rieber, Lee & Utecht

[57] ABSTRACT

A pop-up sprinkler has a sprinkler housing containing a pop-up spray nozzle assembly springably biased to a retracted position. Upon supply of water under pressure to the housing, the assembly pops up to an elevated position to provide an irrigating water spray in a selected direction. A clamping collar prevents rotation of the elevated spray nozzle assembly with respect to the housing.

23 Claims, 5 Drawing Figures

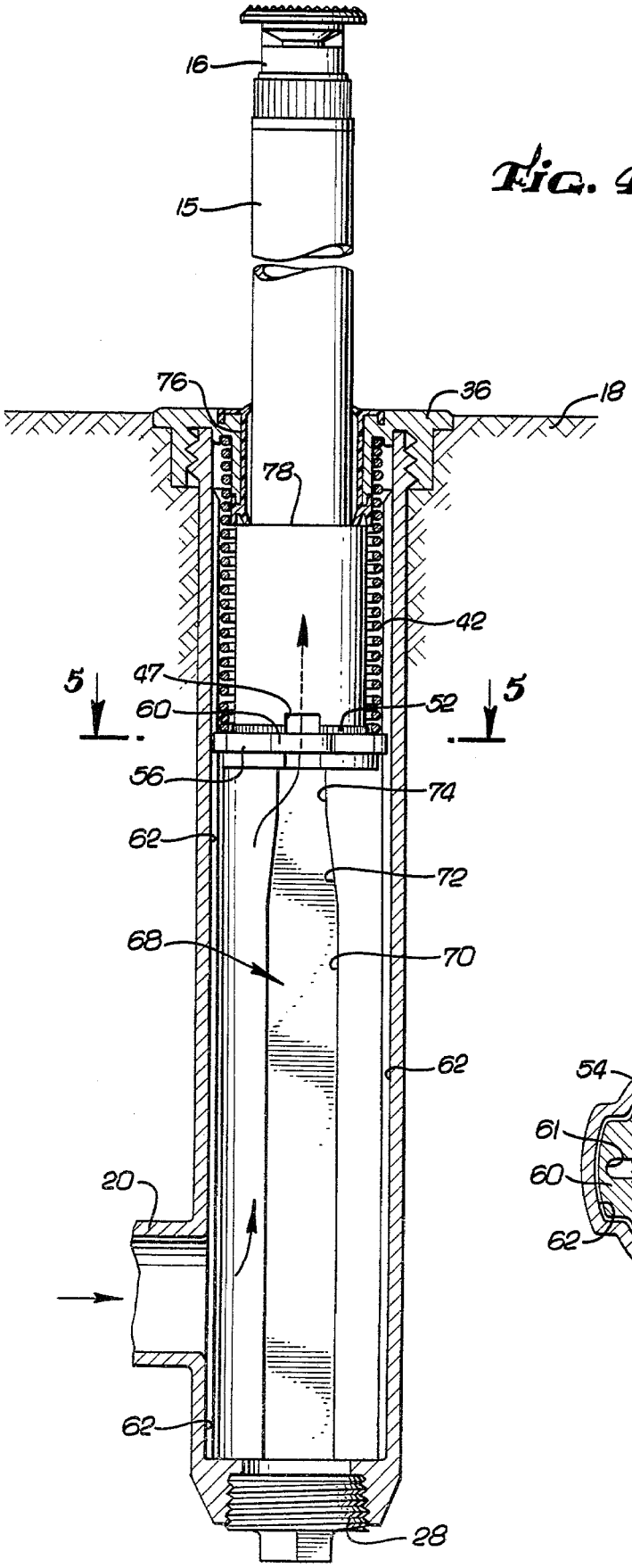
Fig. 4.
Fig. 5.
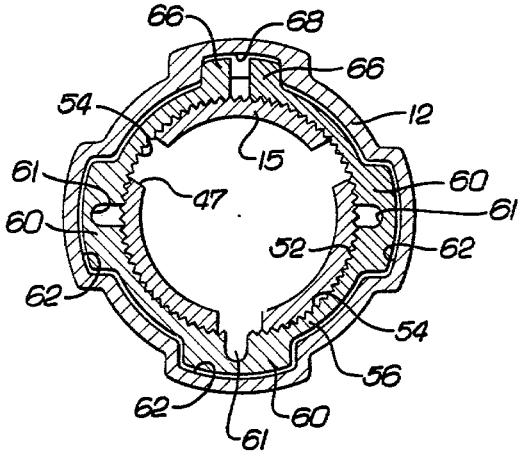

POP-UP SPRINKLER

BACKGROUND OF THE INVENTION

This invention relates to improvements in irrigation sprinklers. More specifically, this invention relates to a pop-up sprinkler having a spray head movable between retracted and elevated positions, and including means for preventing rotation of the spray head with respect to the housing when the spray head is in the elevated position.

Pop-up irrigation sprinklers in general are well known in the art. These sprinklers comprise a sprinkler housing including a coupling for attachment to a suitable line source of water under pressure. A pop-up stem is slidably received within the sprinkler housing, and carries a spray head through which water is sprayed for irrigation purposes. In operation, the pop-up stem is springably or gravitationally biased to a retracted position within the housing wherein the uppermost extent of the spray head is positioned substantially flush with the upper extent of the sprinkler housing and the ground. However, when water under pressure is supplied to the sprinkler housing, the pressure urges the stem to slide upwardly within the housing to carry the spray head to an elevated position above the housing. In this elevated position the water under pressure is emitted as a spray through the spray head for supplying irrigation water to a specified area.

In many instances, it is desirable to direct the irrigation water spray from the spray head generally in a selected direction. In other words, it is sometimes desirable to provide a so-called part circle spray head for use, for example, along the edge of a sidewalk or pavement so as to limit application of the water only to surrounding vegetation. In this regard, it is advantageous to provide a pop-up sprinkler having a spray head rotatable relative to the surrounding vegetation to permit adjustment of the spray head for accurate delivery of water in the desired direction.

In some applications, the sprinkler housing includes a vertically oriented coupling for connection to the water line source. With this type of coupling, it is possible to rotate the entire sprinkler housing and thereby correspondingly rotate the sprinkler spray head for obtaining the desired direction of irrigation spray. However, in such applications, rotation of the sprinkler housing with respect to the line source creates a relatively loose hydraulic connection which tends undesirably to leak, and which allows the housing to rotate on its own in response to vibrational forces during operation. Such relative rotation of the housing is undesirable in that the direction of irrigation spray is altered.

Some pop-up sprinklers include a housing with a horizontally oriented coupling for connection to a line source of water. These housings are not rotatable about a vertical axis for adjustment of the spray head direction. With sprinklers of this type, the pop-up stem is required to be rotated within the sprinkler housing, and this can be accomplished by providing a stem which freely rotates within the housing. However, with this type of construction, the prior art does not provide satisfactory means for locking the stem against rotation once the stem has been rotated to the selected direction, whereby these pop-up sprinkler units are highly susceptible to accidental or purposeful misalignment and misdirection of the irrigation spray resulting in improper irrigation and waste of water. Alternately, a rotationally locked stem can be provided, but this latter construction requires disassembly of the sprinkler unit in order to adjust the direction of the irrigation spray.

The present invention overcomes the problems and disadvantages of the prior art by providing an improved pop-up sprinkler including a pop-up stem with means for locking the stem against accidental or purposeful misdirection of the irrigation spray, and thereby maintain the stem in the selected position of adjustment.

SUMMARY OF THE INVENTION

In accordance with the invention, a pop-up sprinkler comprises a sprinkler housing including a coupling for connection to a supply of water under pressure. A pop-up stem is carried within the housing for vertical sliding movement between a retracted position within the housing, and an elevated or popped-up position with its upper end elevated above the housing. The upper end of the stem carries a directional irrigation spray head through which irrigation water is sprayed for application to a desired area.

The pop-up stem includes external splines for releasable engagement with internal splines of a split ring clamping collar received about the stem and within the housing. The clamping collar includes radially extending guide tabs at its opposite ends in registry with a vertically oriented slot formed in the housing. The slot includes a relatively narrow cross section portion at the top of the housing, and a relatively wide cross section portion disposed below the narrow portion. Within the relatively wide cross section portion of the slot, the tabs at the opposite ends of the collar are allowed to spring apart to disengage the collar from the stem splines and thereby allow rotation of the stem with respect to the housing. However, as the stem moves to the elevated position, the collar is carried upwardly to move the collar tabs into the narrow portion of the slot. This allows the tabs to move toward each other to resist spreading apart of the tabs, and thereby brings the collar and stem splines into engagement to prevent rotation of the stem with respect to the housing.

Other features and advantages of the present invention will become apparent from the following detailed description, taken in conjunction with the accompanying drawings, which illustrate, by way of example, the principles of the invention.

BRIEF DESCRIPTION OF THE DRAWINGS

The accompanying drawings illustrate the invention In such drawings:

FIG. 4 is a vertical section of the pop-up sprinkler showing the pop-up spray nozzle assembly in an elevated position; and FIG. 5 is an enlarged horizontal section taken on the line 5—5 of FIG. 4.

DETAILED DESCRIPTION OF THE PREFERRED EMBODIMENT

Figure 1:
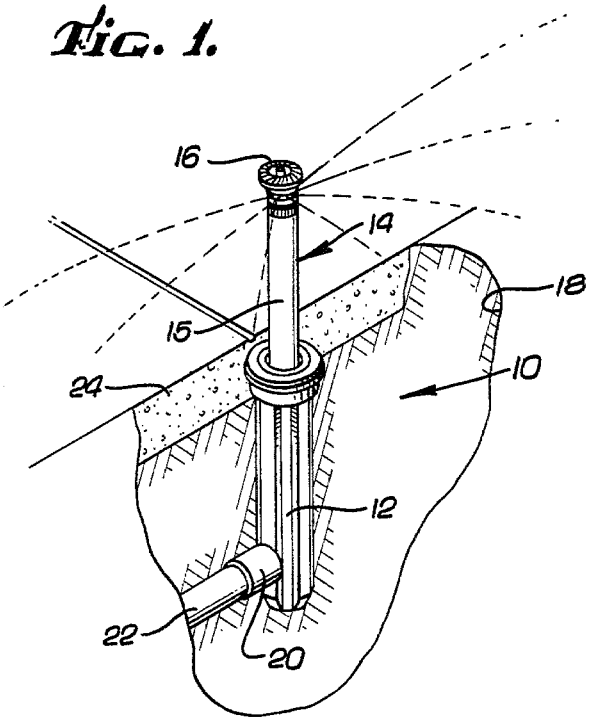
FIG. 1 is a perspective view illustrating use of a pop-up sprinkler of this invention.

A pop-up sprinkler 10 of this invention is shown in FIG. 1, and comprises a generally cylindrical housing 12 carrying a movable pop-up spray nozzle assembly 14.

The housing 12 is adapted for partial burial in the ground 18 with its upper extent generally flush with the surface of the ground. A coupling 20 is formed integrally with the housing 12 for connection as by threading to a water supply pipe 22 for communicating a supply of water under pressure to the interior of the housing 12. In use, as illustrated in FIG. 1, supply of water under pressure to the interior of the housing 12 causes the spray nozzle assembly 14 to move to a popped-up or elevated position. In this elevated position, water under pressure is sprayed outwardly through a spray head 16 for irrigation of grass, shrubs, and the like. In the application shown, the sprinkler 10 is positioned adjacent a pavement 24 or other non-irrigable surface whereupon the spray head 16 comprises a so-called part circle spray head for providing an irrigation spray in a selected direction away from the pavement 24.

The pop-up sprinkler 10 is shown in more detail in FIGS. 2-5. As shown, the housing 12 comprises a generally vertically oriented canister having the coupling 20 formed integrally therewith and extending generally horizontally outwardly in one direction. The lower end of the housing 12 threadably receives therein a lower end cap 28 for sealingly closing the housing lower end. Alternately, if desired, the lower end cap 28 may include a vertically oriented coupling (not shown) for connection to a vertically extending water line source supply pipe in lieu of or in addition to the horizontally oriented coupling 20 shown in the drawings.

Figure 2:
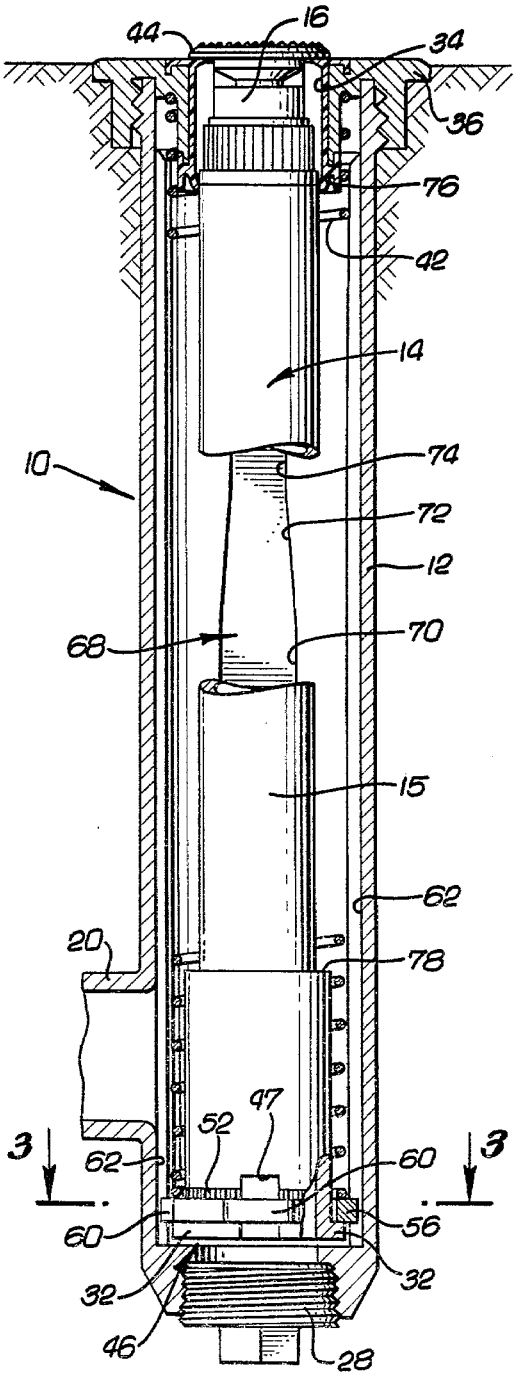
FIG. 2 is a vertical section of the pop-up sprinkler showing a spray nozzle assembly in a retracted position.

The spray nozzle assembly 14 comprises a generally tubular hollow stem 15 extending vertically within the housing 12 and having a radially outwardly projecting flange 32 at its lower end. The stem 15 extends upwardly from the flange 32 and has the spray head 16 suitably secured to its upper end. As shown in FIG. 2, the spray head 16 projects upwardly from the housing 12 through an opening 34 in an upper end cap 36 threadably received over the upper end of the housing. Importantly, the spray head 16 comprises a so-called part circle spray head assembly for application of an irrigating water spray to a specified area in a specific direction. The spray head 16 is generally conventional in form and operation, and thus is not described in detail herein.

A compression coil spring 42 is carried within the housing 12 about the stem 15. The spring 42 reacts between the underside of the upper cap 36 and the stem flange 32 to urge the stem 15 and the spray head 16 downwardly to a normal retracted position within the housing 12. As shown in FIG. 2, the spray head 16 includes an outwardly radiating rim 44 for engagement with the upper cap 36 in the retracted position to prevent passage of the spray head downwardly beyond the cap opening 34. In this retracted position, the length of the stem 15 is such that the stem lower end is spaced above the lower end of the housing 12, as indicated at 46, to allow a flow of water from the coupling 20 upwardly into the stem 15. This water flow into the stem 15 can be enhanced by slots or cutouts 47 which serve to increase the flow area for passage of water into the stem.

Figure 3:
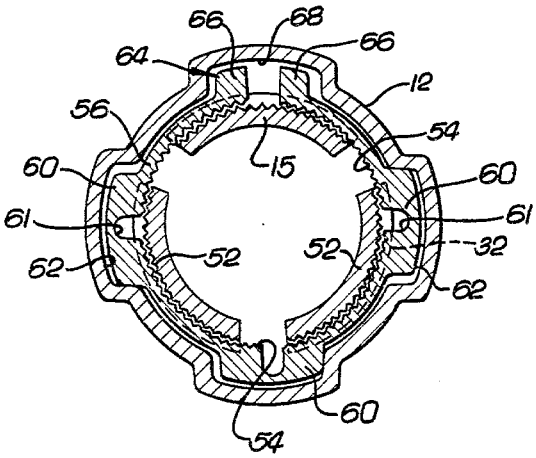
FIG. 3 is an enlarged horizontal section taken on the line 3—3 of FIG. 2.

As shown in FIGS. 2 and 3, an annular row of vertically oriented external splines 52 is formed about the lower end of the stem 15 above and adjacent the stem flange 32. These vertically oriented splines 52 are disposed for releasable gripping engagement with complementary-formed internal splines 54 of a split ring clamping collar 56. This split ring clamping collar 56 comprises an open ring formed from a suitable springable plastic material, and is retained in a seated position upon the stem flange 32 by the spring 42 with its splines 54 in alignment for engagement with the stem splines 52.

The split ring clamping collar 56 includes a plurality of radially outwardly projecting tabs 60 formed at angular intervals about the circumference of the collar and received in vertically extending guide slots 62 formed in the housing 12. An additional tab 64 is defined by a pair of radially outwardly projecting wings 66 formed on the opposite ends of the collar 56. This additional tab 64 is received within a vertically extending control slot 68 formed in the housing 12 to have a varying cross sectional dimension. Conveniently, the three tabs 60 can be formed to include slits 61 to increase the sprinability of the collar, and to provide additional flow passage area for downward flow of water past the stem flange 32.

More specifically, as shown in FIGS. 2 and 3, the control slot 68 comprises a relatively large cross section portion 70 at the lower end of the housing 12 to allow the wings 66 to move apart under spring tension. This correspondingly allows the collar 56 to assume a maximum diameter, and thereby release the collar splines 54 from gripping engagement with the stem splines 52. However, as shown in FIGS. 4 and 5, the upper end of this large cross section portion 70 merges with an intermediate portion 72 of an upwardly narrowing cross section, and this intermediate portion 72 in turn merges with a relatively small cross section slot portion 74 at the upper end of the housing 12. In this manner, upward motion of the stem 15 moves the collar 56 upwardly within the housing 12 to progressively prevent the wings 66 from moving apart within the intermediate narrowing portion 72. This effectively reduces the diameter of the collar 56 to cause gripping engagement between the collar splines 54 and the stem splines 52. Further upward stem movement causes the wings 66 to enter the small cross section slot portion 74 for positive restriction of the collar 56 in a small diameter position with the splines 54 and 52 in engagment with each other. As can be seen, retention of the splines 54 and 52 in gripping engagement with each other positively locks the stem 15 and spray head 16 against rotation with respect to the housing 12.

In operation, supply of water under pressure through the coupling 20 causes the water to flow into the housing 12. The water under pressure overcomes the downward force of the spring 42 to shift the stem 15 and the spray head 16 to the elevated or popped-up position shown in FIGS. 4 and 5. The stem 15 slides upwardly within the housing 12, and carries the clamping collar 56 upwardly with the tabs 60 and the wings 66 respectively guided within the guide slots 62 and the control slot 68. In the elevated position, the wings 66 of the collar 56 are retained in their normal positions relatively close to each other to bring the collar splines 54 into locking engagement with the stem splines 52 to prevent rotation of the spray head 16 with respect to the sprinkler housing 12. In this manner, accidental or purposeful alteration of the directional irrigation spray is positively prevented. Conveniently, as shown in FIG. 4, the opening 34 in the upper cap 36 is lined with a resilient seal 76 which engages an annular shoulder 78 on the stem 15 when the stem is in the elevated position.

A cessation of supply of water under pressure through the coupling 20 allows the compression spring 42 to once again urge the stem 15 and the spray head 16 to the retracted position shown in FIGS. 2 and 3. This urges the clamping collar 56 downwardly to move the wings 66 into the relatively large cross section portion 70 of the slot 68 where the wings 66 can be sprung apart to thereby disengage the collar splines 54 from the stem splines 52. Thus, in the retracted position, the stem 15 and spray head 16 are rotatable within the housing 12 as illustrated in FIG. 3 with the collar splines 54 and stem splines 52 ratcheting over one another to allow directional adjustment of the irrigation spray. However, in the fully retracted position, the spring 42 holds the stem against accidental rotational misdirection of the spray head 16. Moreover, the relatively thin rim 44 of the spray head 16 is not easily grasped by vandals for purposeful misdirection of the spray head.

The direction of irrigation spray is quickly and easily adjusted whenever the stem 15 and the spray head 16 are in a partially elevated position. The stem 15 is easily grasped and pushed downwardly into the housing 12 against the pressure of water supplied to the housing. Movement of the stem 15 downwardly to move the split wings 66 of the collar 56 downwardly into the relatively large cross section portion 70 of the control slot 68 allows the stem 15 to be rotated easily with respect to the housing. Once the desired angle of irrigation spray is obtained, the stem 15 is released to allow the stem to return to the elevated position. Such return once again brings the collar and stem splines 54 and 52 into locking engagement with each other by preventing spreading of the wings 66 to prevent stem and spray head rotation with respect to the housing 12. Importantly, when the stem 15 is in the partially elevated position, the seal 76 provides a downwardly open U-shaped profile which seals under pressure against leakage of water from within the housing past the seal.

A wide variety of modifications and improvements to the invention disclosed herein are believed to be apparent to those skilled in the art. For example, the relatively large cross section portion 70 of the control slot 68 may be limited to only a small intermediate portion of the slot 68, and an additional small cross section portion may be formed to receive the wings 66 at the bottom of the housing. With this arrangement, the stem 15 is positively locked in both the elevated and the retracted positions, and is rotatable only within a narrow intermediate portion of its vertical travel. Accordingly, no limitation on the invention is intended by way of the description herein except as set forth in the appended claims.

What is claimed is:

1. A pop-up sprinkler, comprising:

a housing including an inlet for receiving water under pressure, and a vertically oriented internal slot having a first portion of relatively small cross section and a second portion of relatively large cross section;

a spray nozzle assembly including a spray head and mounted with respect to said housing in communication with the water under pressure supplied to said housing for sliding movement between a retracted position generally within said housing, and an elevated position with said spray head elevated above said housing; and a split ring clamping collar received within said housing about said spray nozzle assembly for sliding movement with said assembly, said collar including tab means at its opposite ends received within said slot, said tab means being movable when received in said slot first portion so that said collar assumes a reduced diameter position to bring said collar into gripping engagement with said assembly to prevent rotation of said assembly within said housing, and movable when received in said slot second portion to allow said collar to assume an increased diameter position to release said collar from gripping engagement with said assembly to permit rotation of said assembly within said housing.

2. The sprinkler of claim 1 wherein said slot first portion is disposed at the upper end of said slot, and said slot second portion is disposed below said first portion, and further including an upwardly narrowing third slot portion merging between said first and second slot portions.

3. The sprinkler of claim 1 wherein said spray nozzle assembly comprises a pop-up stem mounted within said housing for vertical sliding movement and having said spray head carried at the upper end thereof, said stem having a locking surface formed thereon, and said collar having a locking member disposed in alignment with said locking surface for gripping engagement therewith.

4. The sprinkler of claim 3 wherein said locking surface comprises a plurality of generally vertically oriented splines on said stem, and wherein said locking member comprises a plurality of complementary, generally vertically oriented splines on said collar.

5. The sprinkler of claim 1 wherein said collar is formed from a springable material, and is sized to assume a normal configuration in the reduced diameter position to grippingly engage said assembly.

6. The sprinkler of claim 1 including a plurality of additional vertically oriented slots formed in said housing, said collar including a plurality of radially outwardly projected tabs for reception in respective ones of said additional slots, said tabs and said tab means preventing rotation of said collar with respect to said housing throughout vertical sliding movement of said collar.

7. The sprinkler of claim 1 including spring means reacting between said housing and said assembly for urging said assembly toward said retracted position, said assembly being urged toward said elevated position by the pressure of water supplied to said housing.

8. A pop-up sprinkler, comprising:

a housing including an inlet for receiving water under pressure;

a spray nozzle assembly mounted with respect to said housing for vertical sliding movement between a retracted position generally within said housing and an elevated position with its upper end elevated above said housing; and means within said housing and movable with said assembly for permitting substantially full circle rotation of said assembly with respect to said housing throughout at least a portion of the vertical movement of said assembly below said elevated position to permit adjustment of said assembly to a selected rotational position, and for grippingly engaging said assembly when said assembly is in said elevated position for locking said assembly in said selected rotational position.

9. The sprinkler of claim 8 wherein said means comprises a split ring clamping collar received within said housing and about said assembly, and springable between a normal reduced diameter configuration in gripping engagement with said assembly, and an expanded diameter configuration out of gripping engagement with said assembly, and further including control means for restricting said collar to said reduced diameter configuration when said assembly is in said elevated position, and for allowing movement of said collar to said expanded diameter configuration throughout at least a portion of vertical movement of said assembly below said elevated position.

10. The sprinkler of claim 9 wherein said housing includes a vertically oriented internal slot having a relatively small cross section portion at the upper end thereof, and a relatively large cross section portion below said small cross section portion, said control means comprising a pair of outwardly radiating wings at opposite ends of said collar and received in said slot, said wings being restricted to positions relatively close to each other when received in said small cross section portion of said slot.

11. The sprinkler of claim 9 wherein said assembly comprises a pop-up stem mounted within said housing for vertical sliding movement and a spray head at the upper end of said stem, said stem including a plurality of radially outwardly presented and generally vertically oriented splines, and said collar including a plurality of radially inwardly presented and generally vertically oriented splines for releasable gripping engagement with said stem splines.

12. The sprinkler of claim 8 including spring means reacting between said housing and said assembly for urging said assembly toward said retracted position, said assembly being urged toward said elevated position by the pressure of water supplied to said housing.

13. A pop-up sprinkler, comprising:

a housing including an inlet for receiving water under pressure, and a generally vertically oriented internal slot having a first portion of relatively small cross section and a second portion of relatively large cross section;

a spray nozzle assembly including a spray head and mounted with respect to said housing in communication with the water under pressure for sliding movement between a retracted position generally within said housing, and an elevated position with said spray head elevated above said housing, said assembly including a locking surface; and a split ring clamping collar received within said housing about said spray nozzle assembly, said collar including tab means at its opposite ends received within said slot and at least one locking member presented for gripping engagement with said locking surface of said assembly, said tab means being movable when received in said slot first portion to reduce the diameter of said collar to engage said locking member with said locking surface to prevent rotation of said assembly with respect to said housing, and movable when received in said slot second portion to permit an increase in the diameter of said collar to disengage said locking member from said locking surface to permit rotation of said assembly with respect to said housing.

14. The sprinkler of claim 13 wherein said slot first portion is disposed at the upper end of said slot, and said slot second portion is disposed below said first portion, and further including an upwardly narrowing third slot portion merging between said first and second slot portions.

15. The sprinkler of claim 13 wherein said spray nozzle assembly comprises a pop-up stem mounted within said housing for vertical sliding movement and having said spray head at the upper end thereof, said locking surface on said stem comprising a plurality of generally vertically oriented splines, and said locking member on said collar comprising a plurality of complementary, generally vertically oriented splines.

16. The sprinkler of claim 13 wherein said collar is formed from a springable material, and is sized to assume a normal configuration with its opposite ends relatively close to each other for orienting said collar in a reduced diameter configuration in gripping engagement with said assembly.

17. The sprinkler of claim 13 including a plurality of additional vertically oriented slots formed in said housing, said collar including a plurality of radially outwardly projected tabs for reception in respective ones of said additional slots, said tabs and said tab means preventing rotation of said collar with respect to said housing throughout vertical sliding movement of said collar.

18. The sprinkler of claim 13 including spring means reacting between said housing and said assembly for urging said assembly toward said retracted position, said assembly being urged toward said elevated position by the pressure of water supplied to said housing.

19. The sprinkler of claim 18 wherein said assembly includes a radially outwardly directed flange adjacent said locking surface, said collar being received about said assembly and supported on said flange, said spring means reacting between said housing and said collar for retaining said collar in position for vertical movement with said assembly and with said locking member in gripping alignment with said locking surface.

20. A pop-up sprinkler comprising:

a housing including an inlet for receiving water under pressure, and a plurality of vertically oriented internal slots, one of said slots comprising a control slot having at its upper end a first portion of relatively small cross section, a second portion of relatively large cross section below said first portion, and an intermediate upwardly narrowing third portion merging between said first and second portions;

a pop-up stem received in said housing for vertical sliding movement between a retracted position generally within said housing, and an elevated position with its upper end elevated above said housing;

a spray head at the upper end of said stem for movement therewith and in communication with water under pressure supplied into said housing;

a plurality of externally presented and generally vertically oriented splines formed on said stem; and a split ring clamping collar received within said housing about said stem, said collar including a plurality of internally presented and generally vertically oriented splines for engagement with said stem splines, and a plurality of outwardly radiating tabs received in respective ones of said slots for preventing rotation of said collar with respect to said housing and for guiding said collar for vertical sliding movement with said stem within said housing, one of said tabs comprising a pair of outwardly radiating wings at opposite ends of said collar and received in said control slot, said wings being springable toward each other and restricted against spreading apart when received in said slot first portion to reduce the diameter of said collar to bring said collar splines into locking engagement with said stem splines for preventing rotation of said stem within said housing, and springable away from each other when received in said second slot portion to allow an increase in the diameter of said collar sufficiently to lockingly disengage said collar splines from said stem splines for permitting rotation of said stem with respect to said housing.

21. The sprinkler of claim 20 wherein said spray head comprises a directional spray head assembly.

22. The sprinkler of claim 20 wherein said housing includes an opening for vertical sliding passage of said stem, said sprinkler further comprising spring means reacting between said housing and said stem for urging said stem to a retracted position, said stem being urged toward said elevated position by the pressure of water supplied to said housing.

23. The sprinkler of claim 22 wherein said stem includes an outwardly radiating flange below said stem splines, said collar being supported on said flange and retained thereon by said spring means reacting between said collar and said housing.

* * * * *